US008220428B2

(12) United States Patent
Lee

(10) Patent No.: US 8,220,428 B2
(45) Date of Patent: Jul. 17, 2012

(54) CONTINUOUS VARIABLE VALVE LIFT APPARATUS

(75) Inventor: Eun Ho Lee, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 455 days.

(21) Appl. No.: 12/533,715

(22) Filed: Jul. 31, 2009

(65) Prior Publication Data

US 2010/0071645 A1 Mar. 25, 2010

(30) Foreign Application Priority Data

Sep. 25, 2008 (KR) ..... 10-2008-0094106

(51) Int. Cl.
*F01L 1/34* (2006.01)

(52) U.S. Cl. ..... 123/90.16; 123/90.15

(58) Field of Classification Search ..... 123/90.16, 123/90.15

See application file for complete search history.

(56) References Cited

U.S. PATENT DOCUMENTS 6,390,041 B2 5/2002 Nakamura et al.
6,439,177 B2 * 8/2002 Pierik ..... 123/90.16
6,595,172 B2 7/2003 Kabasin et al.
7,111,600 B2 * 9/2006 Naumann ..... 123/90.39
7,188,595 B2 * 3/2007 Hara ..... 123/90.16
7,246,578 B2 7/2007 Nakamura et al.
7,451,729 B2 * 11/2008 Sugiura et al. ..... 123/90.16
7,814,873 B2 * 10/2010 Tateno et al. ..... 123/90.16
7,823,552 B2 11/2010 Kwon et al.

FOREIGN PATENT DOCUMENTS

JP 2006-70735 A 3/2006

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A continuously variable valve lift apparatus includes an input cam disposed on an input shaft, a valve opening unit, a control shaft disposed in parallel with the input shaft, a variable member that contacts the input cam, wherein a relative distance between a contact portion of the variable member and the input cam, and the control shaft is variable according to relative angel changes between the variable member and the control shaft, a driving unit that is connected with the variable member and pivots around the control shaft and a driving cam that is disposed between the driving unit and the valve opening unit and drives the valve opening unit according to the pivoting of the driving unit.

9 Claims, 5 Drawing Sheets

CONTINUOUS VARIABLE VALVE LIFT APPARATUS

CROSS-REFERENCE TO RELATED APPLICATION

The present application claims priority of Korean Patent Application Number 10-2008-0094106 filed Sep. 25, 2008, the entire contents of which application is incorporated herein for all purposes by this reference.

BACKGROUND OF THE INVENTION

1. Field of the Invention

The present invention relates to a continuous variable valve lift apparatus. More particularly, the present invention relates to a continuous variable valve lift apparatus that can adjust a valve lift amount in response to an operational state of an engine.

2. Description of Related Art

A typical combustion chamber of an automotive engine is provided with an intake valve for supplying the air/fuel mixture containing the fuel and an exhaust valve for expelling the burned gas. The intake and exhaust valves are opened and closed by a valve lift apparatus connected to a crankshaft.

A conventional valve lift apparatus has a fixed valve lift amount due to a cam shape. Therefore, it is impossible to adjust the amount of a gas that is being introduced or exhausted. Therefore, the engine does not run at its optimum state in various driving ranges.

If the valve lift apparatus is designed for low speed, the valve open time and amount are not sufficient for high speeds driving state. On the other hand, if the valve lift apparatus is designed for high speeds, the opposite is true.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention provide for a continuous variable valve lift apparatus that can adjust a valve lift amount in response to an operational state of an engine.

According to various aspects of the present invention, a continuous variable valve lift apparatus can easily adjust valve profiles with a simple scheme.

A continuously variable valve lift apparatus according to various aspects of the present invention may include an input cam disposed on an input shaft, a valve opening unit, a control shaft disposed in parallel with the input shaft, a variable member that contacts the input cam, wherein a relative distance between a contact portion of the variable member and the input cam, and the control shaft is variable according to a relative rotation angel of the variable member around the control shaft, a driving unit that is connected with the variable member and pivots around the control shaft and a driving cam that is disposed between the driving unit and the valve opening unit and drives the valve opening unit according to the pivoting of the driving unit.

The variable member may include a control link disposed on the control shaft, a first connecting link connected with the control link and a second connecting link connected with the first connecting link.

The continuously variable valve lift apparatus may further include an input roller that is disposed on a portion where the first connecting link and the second connecting link are connected, wherein the input roller contacts the input cam.

The first connecting link may pivot around a connecting portion of the control link and the first connecting link.

The driving unit may include a first body connected to the second connecting link and a second body provided with a driving roller that contacts the driving cam.

The driving cam may pivot around a driving camshaft parallel with the control shaft.

The driving cam may be curved along the longitudinal direction thereof.

The driving cam may comprise a first portion and a second portion and wherein a cross-section of the first portion is constantly formed and a cross-section of the second portion is gradually thicker away from the deriving camshaft.

A continuously variable valve lift apparatus according to various embodiments of the present invention may include an input cam disposed on an input shaft, a control shaft disposed in parallel with the input shaft, a variable member that contacts the input cam, pivots around the control shaft and of which relative length is variable according to a relative rotation angel of the variable member around the control shaft, a driving unit that is connected with the variable member and pivots around the control shaft; and a driving camshaft parallel to the control shaft, a driving cam pivots around the driving camshaft according to pivoting of the driving unit and a valve opening unit that contacts the driving cam and is opened/closed.

The variable member may include a control link disposed on the control shaft, a first connecting link connected with the control link and a second connecting link connected with the first connecting link.

The driving unit may include a first body connected to the second connecting link and a second body provided with a driving roller that contacts the driving cam.

The driving cam may be curved along the longitudinal direction thereof.

The driving cam may include a first portion and a second portion and wherein a cross-section of the first portion is constantly formed and a cross-section of the second portion is gradually thicker away from the deriving camshaft.

According to various aspects of the present invention, the variable valve lift apparatus may easily modulate valve profile according to driving condition with a simple structure.

When valve lift is changed from high lift mode to low lift mode, valve lift is advanced so that engine performance can be improved in the low lift mode.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
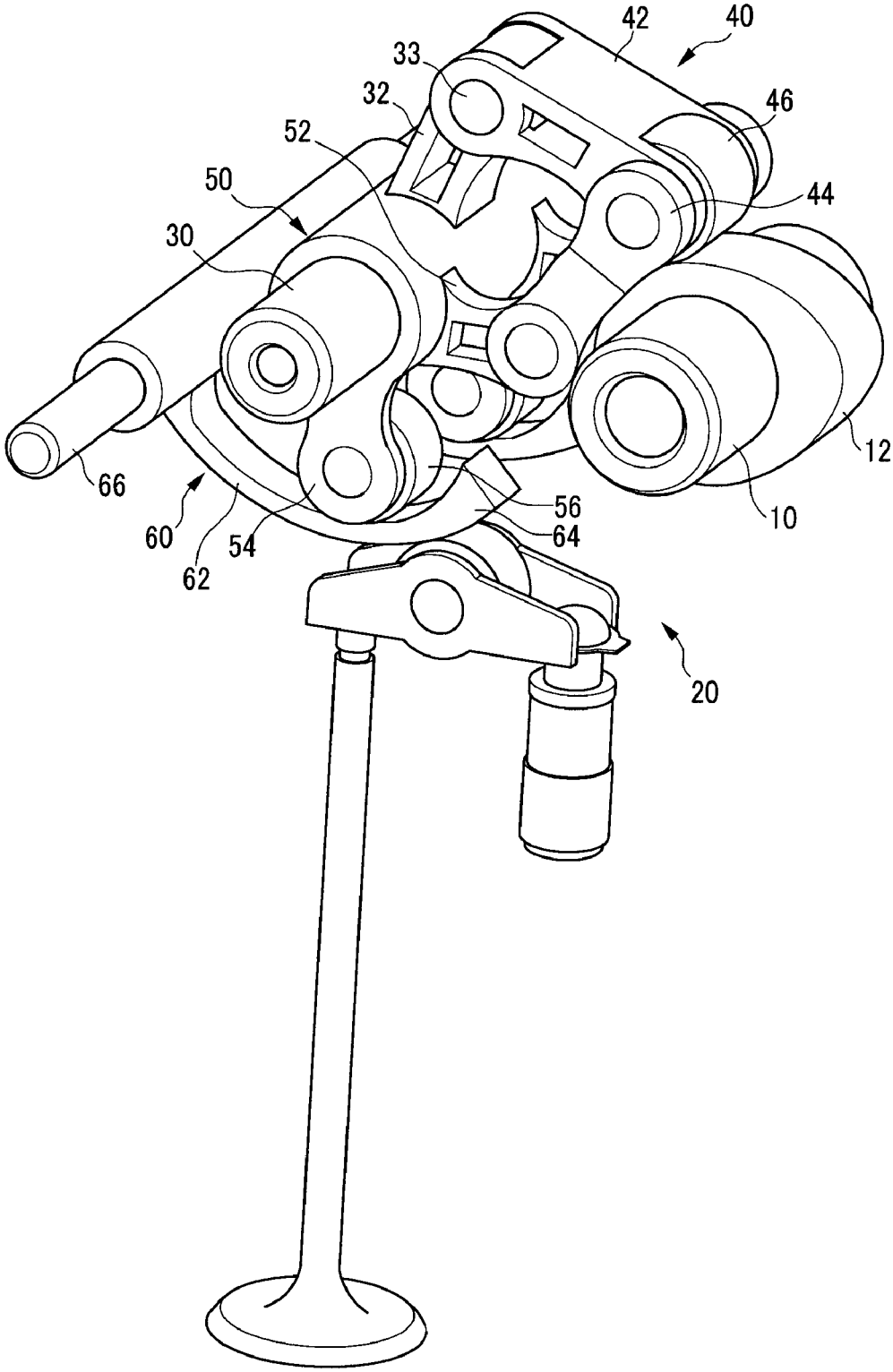
FIG. 1 is a perspective view of an exemplary continuously variable valve lift apparatus according to the present invention.

FIG. 1 is a perspective view of a continuously variable valve lift apparatus according to various embodiments of the present invention.

Figure 2:
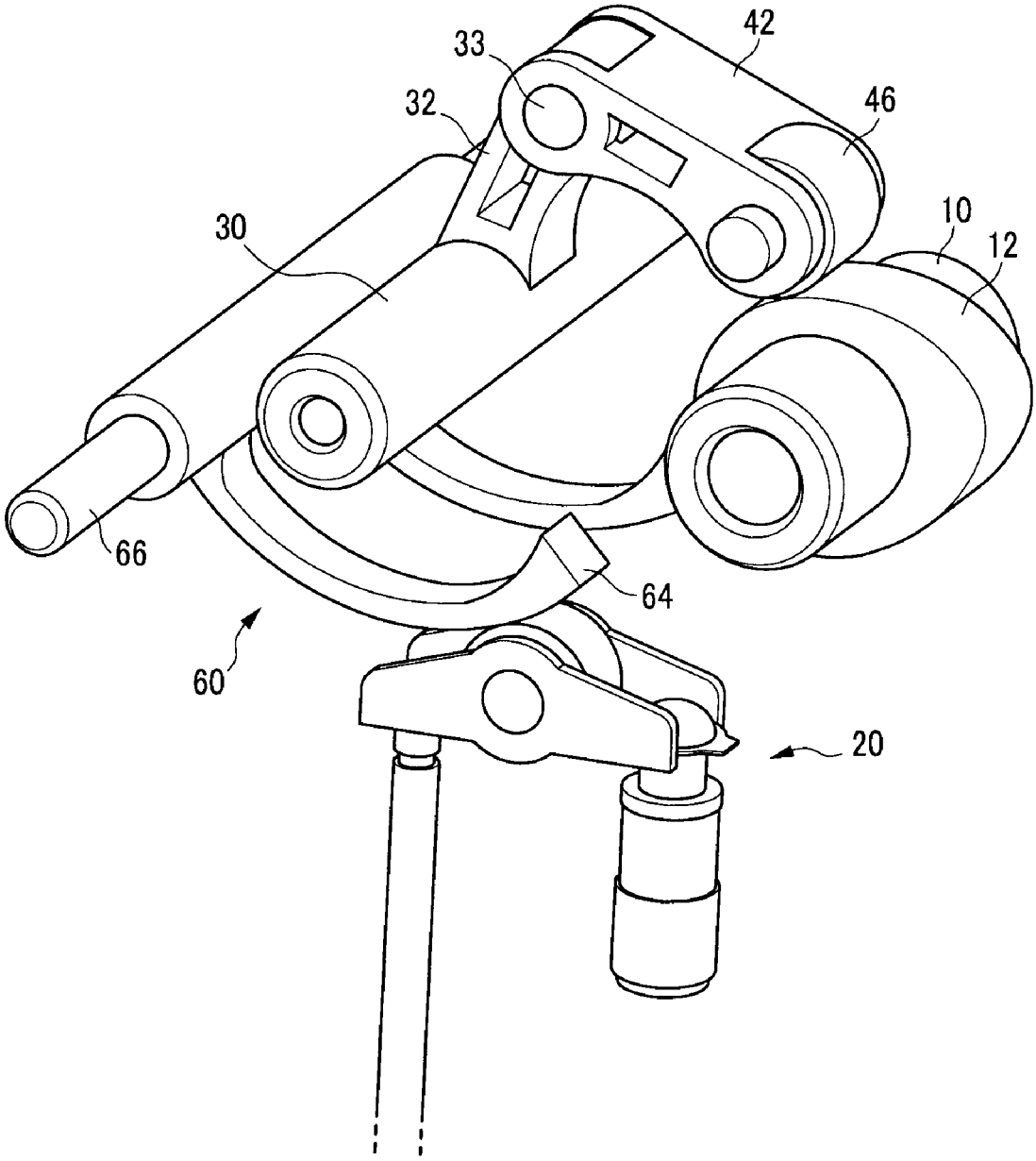
FIG. 2 is a drawing showing partial elements of FIG. 1.

FIG. 2 is a drawing showing partial elements of FIG. 1.

Hereinafter, referring to FIG. 1 and FIG. 2, a continuously variable valve lift apparatus according to various embodiments of the present invention includes an input cam 12 disposed on an input shaft 10, a valve opening unit 20, a control shaft 30 disposed in parallel with the input shaft 10.

A variable member 40 contacts the input cam 12, and a relative distance between a contact portion of the variable member 40 and the input cam 12, and the control shaft 30 is variable according to a relative rotation angel of the variable member 40 around the control shaft 30 and the variable member 40 is disposed on the control shaft 30.

A driving unit 50 is connected to the variable member 40 and pivots around the control shaft 30, and a driving cam 60 disposed between the driving unit 50 and the valve opening unit 20 and drives the valve opening unit 20 by pivoting of the driving unit 50.

the variable member 40 includes a control link 32 disposed on the control shaft 30, a first connecting link 42 connected to the control link 32 and second connecting link 44 connected to the first connecting link 42.

An input roller 46 is disposed on a portion where the first connecting link 42 and the second connecting link 42 are connected, and the input roller 46 contacts the input cam 12 so that rotation of the input roller 46 is transmitted to the variable member 40 through the input roller 46.

The driving unit 50 includes a first body 52 connected to the second connecting link 44 and a second body 54 provided with a driving roller 56 that contacts the driving cam 60.

A relative distance between the control link 32 and the input roller 46 is variable according to a relative rotation angle of the control link 32 around the control shaft 30.

The relative rotation angle of the control link 32 around the control shaft 30 may be controlled by a control motor or a control actuator in an otherwise conventional manner, and as operations of the control motor or the control actuator are otherwise conventional, a detailed explanation will be omitted.

The driving cam 60 pivots around driving a camshaft 66 parallel with the control shaft 30.

The driving cam is curved along the longitudinal direction thereof, and the driving cam 60 includes a first portion 62 and a second portion 64, wherein a cross-section of the first portion 62 is constantly formed and a cross-section of the second portion 64 is gradually thicker away from the deriving camshaft 66.

Hereinafter, changes of the valve lift will be described.

Figure 3:
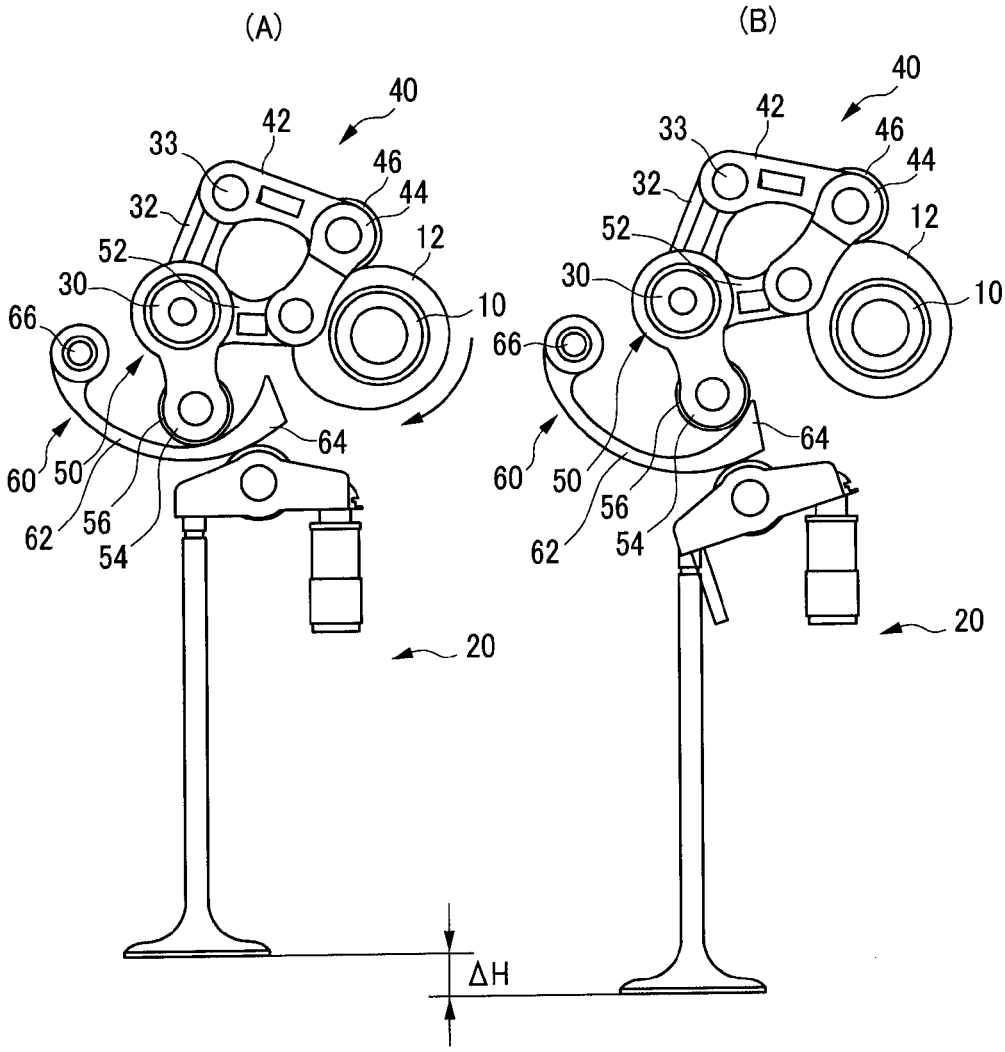
FIG. 3 is a drawing showing operation in high lift mode of an exemplary continuously variable valve lift apparatus according to the present invention.
Figure 4:
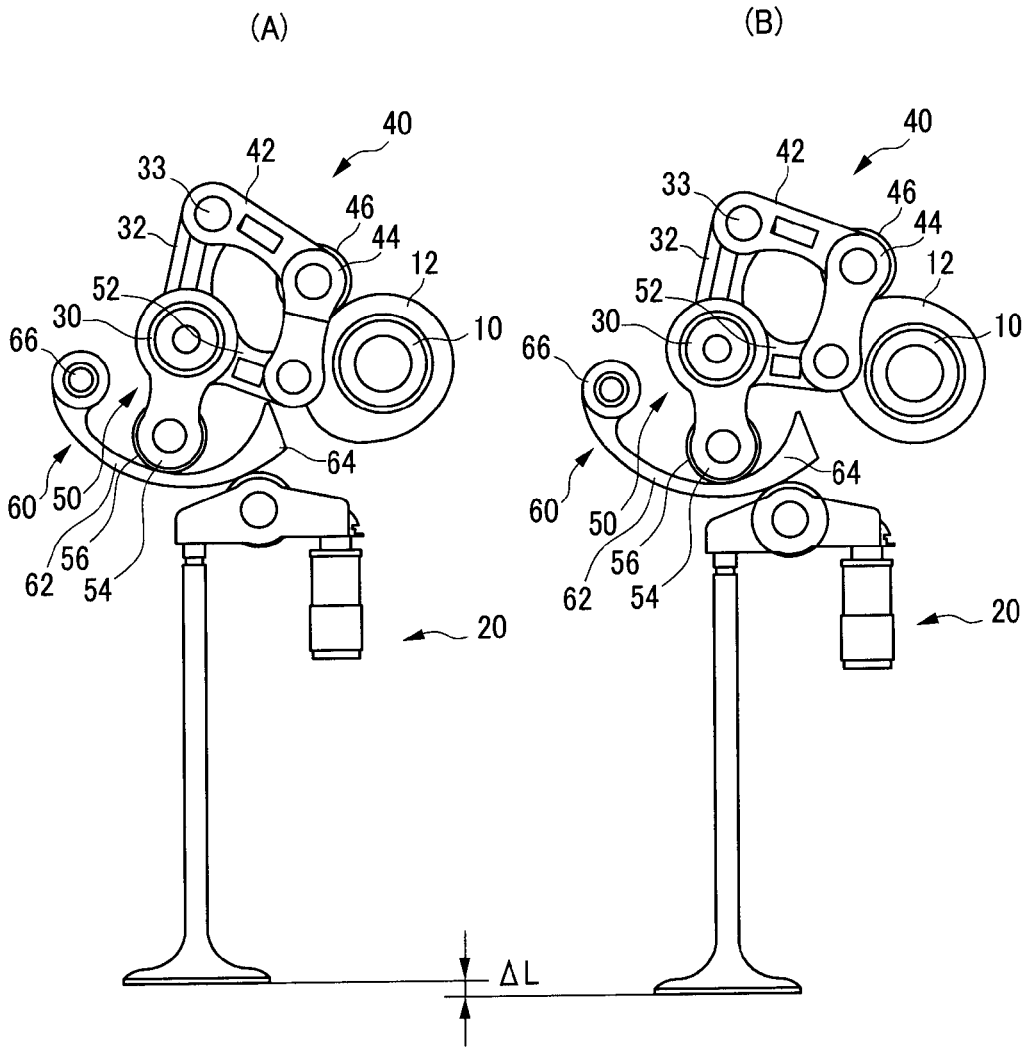
FIG. 4 is a drawing showing operation in low lift mode of an exemplary continuously variable valve lift apparatus according to the present invention.

FIG. 3 and FIG. 4 are drawings showing operation in high lift mode and low lift mode of a continuously variable valve lift apparatus according to various embodiments of the present invention.

FIG. 3(A) shows a valve closed state in the high lift mode and FIG. 3(B) shows a valve opened state in the high lift mode.

The control link 32 is fixed to the present position, the input cam 12 rotates in clockwise direction and the first connecting link 42 pivots around a connecting portion 33 where the first connecting link 42 and the control link 32 are connected with contacting of the input roller 46 and the input cam 12.

Then, the driving roller 56 rotates in anticlockwise direction around the control shaft 30 by the second connecting link 44 connected with the input roller 46.

The driving cam 60 contacting the driving roller 56 pivots around the driving camshaft 66.

The driving roller 56 pushes the second portion 64 and then the valve opening unit 20 is opened (ΔH) as shown in FIG. 3(B).

The variable member 40 and the valve opening unit 20 return to the state of FIG. 3(A) according to rotation of the input cam 12 and the above described operations repeat.

If engine operation conditions are changed to a low speed or a low load, the relative rotation angle of the control link 32 around the control shaft 30 is changed.

FIG. 4(A) shows a valve closed state in the low lift mode and FIG. 4(B) shows a valve opened state in the low lift mode.

Comparing to the high lift mode as shown in FIG. 3, the control link 32 rotates in anticlockwise direction.

Then relative distance between the input roller 46 and the control link 32 is closed and the driving roller 56 relatively rotates in clockwise direction.

So that an interval that the driving roller 56 contacts the first portion 62 of the driving cam 60 is relatively extended and an interval that the driving roller 56 contacts the second portion 64 of the driving cam 60 is relatively shortened.

Thus, in the low lift mode, valve opening time is shortened and valve lift is lessened (ΔL).

In various embodiments of the present invention, the high lift mode and low lift mode are explained; however, the valve lift can be modulated continuously.

Figure 5:
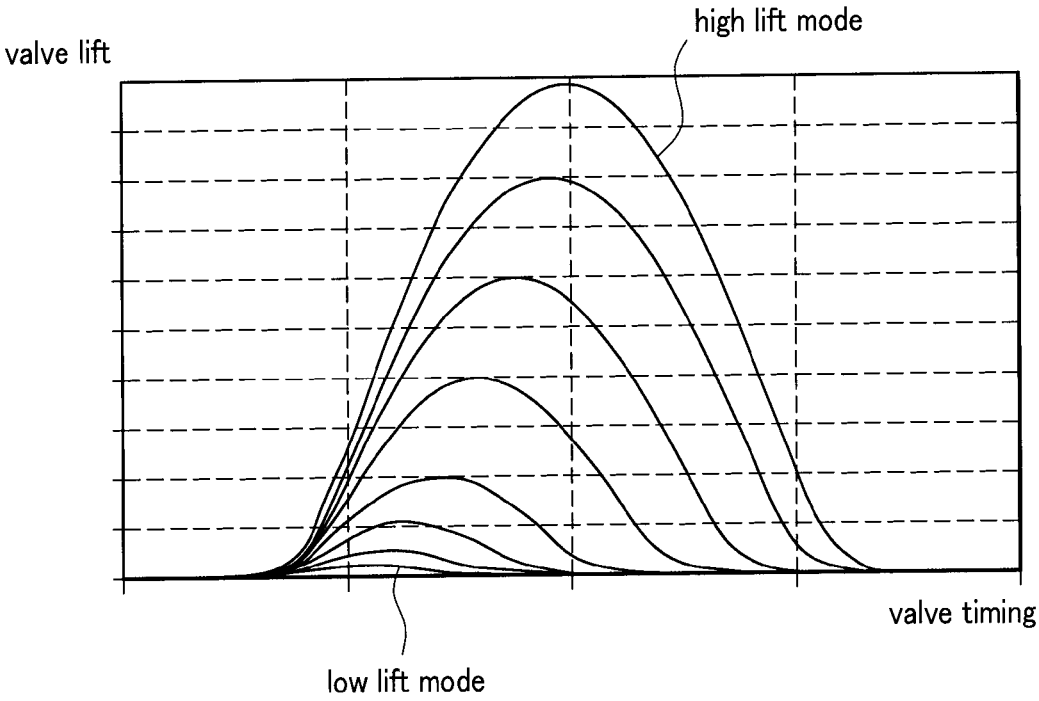
FIG. 5 is a drawing showing valve lift profile of an exemplary continuously variable valve lift apparatus according to the present invention.

That is, as shown in FIG. 5, the valve lift can be continuously changed by modulating of a position of the control link 32.

Also, slight design change of the first portion 62 and the second portion 64 can achieve CDA (cylinder deactivation).

That is, if the first portion 62 is elongated or the control link 32 is turned to anticlockwise direction, CDA (cylinder deactivation) can be achieved.

When the lift mode is changed to the low lift mode, as shown in FIG. 5, turning direction of the control link 32 is opposite to that of the input cam 12 so that the valve lift is advanced.

Thus, engine performance can be improved in the low load driving condition.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift apparatus comprising:
an input cam disposed on an input shaft;
a valve opening unit;
a control shaft disposed in parallel with the input shaft;
a variable member that contacts the input cam, wherein a relative distance between a contact portion of the variable member and the input cam, and the control shaft is variable according to a relative rotation angel of the variable member around the control shaft;
a driving unit that is connected with the variable member and pivots around the control shaft; and
a driving cam that is disposed between the driving unit and the valve opening unit and that drives the valve opening unit according to the pivoting of the driving unit;
wherein the variable member comprises:
a control link disposed on the control shaft;
a first connecting link connected with the control link; and
a second connecting link connected with the first connecting link; and
wherein the driving unit comprises:
a first body connected to the second connecting link; and
a second body provided with a driving roller that contacts the driving cam.

2. The continuously variable valve lift apparatus of claim 1, further comprising an input roller that is disposed on a portion where the first connecting link and the second connecting link are connected, wherein the input roller contacts the input cam.

3. The continuously variable valve lift apparatus of claim 1, wherein the first connecting link pivots around a connecting portion of the control link and the first connecting link.

4. The continuously variable valve lift apparatus of claim 1, wherein a driving camshaft is disposed parallel with the control shaft and the driving cam pivots around the driving camshaft.

5. The continuously variable valve lift apparatus of claim 4, wherein the driving cam comprises a first portion and a second portion; and wherein:
a cross-section of the first portion is constantly formed; and
a cross-section of the second portion is gradually thicker away from the deriving camshaft.

6. The continuously variable valve lift apparatus of claim 1, wherein the driving cam is curved along the longitudinal direction thereof.

7. A continuously variable valve lift apparatus comprising:
an input cam disposed on an input shaft;
a control shaft disposed in parallel with the input shaft;
a variable member that contacts the input cam, pivots around the control shaft and of which a relative length is variable according to a relative rotation angel of the variable member around the control shaft;
a driving unit that is connected with the variable member and pivots around the control shaft;
a driving camshaft parallel to the control shaft;
a driving cam pivots around the driving camshaft according to pivoting of the driving unit; and
a valve opening unit that contacts the driving cam and is opened/closed;
wherein the variable member comprises:
a control link disposed on the control shaft;
a first connecting link connected with the control link; and
a second connecting link connected with the first connecting link; and
wherein the driving unit comprises:
a first body connected to the second connecting link; and
a second body provided with a driving roller that contacts the driving cam.

8. The continuously variable valve lift apparatus of claim 7, wherein the driving cam is curved along the longitudinal direction thereof.

9. The continuously variable valve lift apparatus of claim 7, wherein the driving cam comprises a first portion and a second portion; and wherein:
a cross-section of the first portion is constantly formed; and
a cross-section of the second portion is gradually thicker away from the deriving camshaft.

* * * * *